United States Patent [19]

Wiencek et al.

[11] 4,431,189

[45] Feb. 14, 1984

[54] MULTI-SIDE SELECTION OF AN ELECTRONICALLY SIMULATED DIE

[76] Inventors: Donald C. Wiencek, 14030 S. Laramie, Crestwood, Ill. 60445; Robert B. Zajeski, 9105 S. Roberts Rd., Hickory Hills, Ill. 60457

[21] Appl. No.: 290,611

[22] Filed: Dec. 30, 1981

[51] Int. Cl.[3] ..... A63F 9/04

[52] U.S. Cl. ..... 273/138 A

[58] Field of Search ..... 273/138 A, 1 E, 237

[56] References Cited

U.S. PATENT DOCUMENTS 4,124,881 11/1978 Haber ..... 273/138 A X

FOREIGN PATENT DOCUMENTS 2546117 4/1977 Fed. Rep. of Germany ... 273/138 A 2425681 1/1980 France ..... 273/138 A

OTHER PUBLICATIONS

*Popular Electronics;* "Spots Before Your Eyes"; Sep. 1967; pp. 29–34.

*Popular Electronics;* "Pseudorandom Number Generator"; Dec. 1979; p. 98.

*Popular Mechanics;* "Roll Your Own Electronic Dice"; Mar. 1979; pp. 14, 17, 18, 210.

*Radio & Electron Conductor; "Illuminated Dice"; Apr. 1979; pp. 475, 477, 479.*

*Primary Examiner*—Vance Y. Hum

*Attorney, Agent, or Firm*—DB Enterprises

[57] ABSTRACT

In electronic random die, where a device electronically determines a simulated roll of a six-sided die (or two-sided dice), the circuit consists of a multi-position switch and related circuitry which allows the device to also simulate a roll of a die other than six-sided, namely four-sided, eight-sided, twelve-sided, twenty-sided, or one hundred sided. All of these die rolls are available on this one device.

1 Claim, 2 Drawing Figures

MULTI-SIDE SELECTION OF AN ELECTRONICALLY SIMULATED DIE

BACKGROUND OF THE INVENTION

Random electronic die typically accomplish the die roll by counting through the dice progression at a high speed. When the counting is stopped, the last die progression is exhibited. The length of the counting time, and therefore the randomless, is determined by the operator and the high speed clock. This invention utilizes the same method of random number determination.

Random electronic die currently available simulate the roll of two-six sided dice only. There is a need however, for die generation other than two six-sided dice. There are many games existing today that require the following different dice: four sided, eight sided, twelve sided, twenty sided, and one hundred sided die. Our device would simulate these die rolls.

SUMMARY

The variable electronic random die is capable of simulating electronically the previously stated die roll. The device consists of a counting circuit, containing two decade counters and a clocking chip, capable of counting from 1-100 two hundred times a second. The six-position rotary switch allows the operator to select the sided-die desired. The rotary switch connects the reset gate of the decade counters to the output gate of the number selected (e.g. the output gate of the number six for a six-sided die). The momentary switch starts and stops the counting circuit. With the power on, by pressing and releasing a momentary pushbutton switch, an LED will light next to a number printed on the case. The number is the number rolled and will fall in the range selected with the rotary switch. The randomness of the number rolled is determined by the internal clock, pulsing at a rate of approximately 2,000 cycles per second, and the time the operator holds the momentary switch. The result of the die roll is displayed by lighting the led next to the number on the case.

BRIEF DESCRIPTION OF DRAWINGS

The drawing in FIG. 1 contains the front view of our case, showing the locations of the LED's and switches.

The drawing in FIG. 2 contains the electronic schematic of our invention.

DETAILED DESCRIPTION

Figure 1:
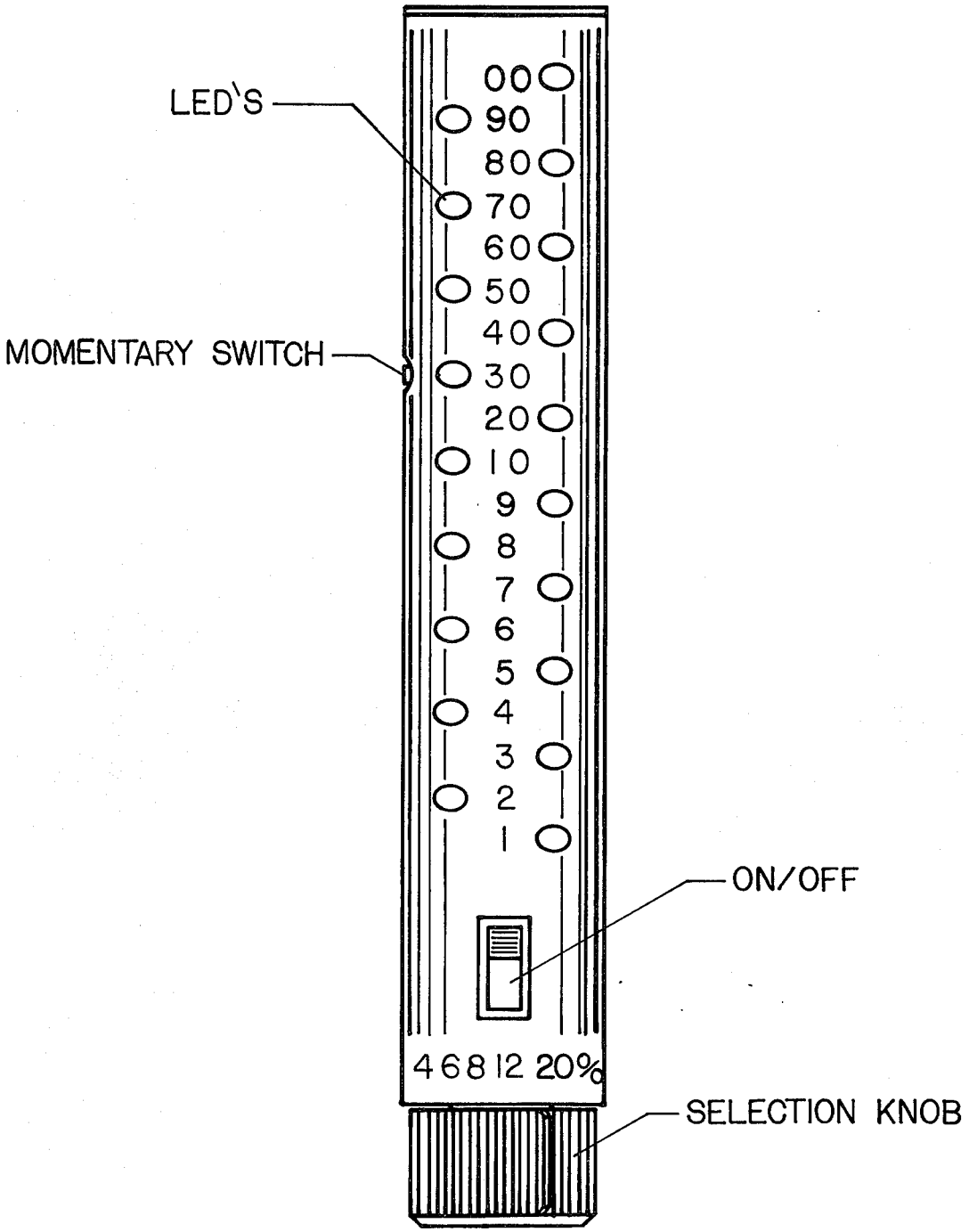

The purpose of our product is to randomly select a number within and including the following ranges (listed again for convenience); 1-4, 1-6, 1-8, 1-12, 1-20, and 1-100. The range desired is determined by the position of the ROTARY SWITCH(1) shown in FIG. 1. When the MOMENTARY SWITCH(2) is pressed, the die begins counting. The counting is provided by the NAND GATE(3) CMOS 4011. The NAND GATE(3) is designed to produce a square wave output, whose frequency is determined through the selection of the resistor(4) and capacitor(5).

The output of the NAND GATE(3) is fed into the input (PIN 14) of the DECADE COUNTER(6) CMOS 4017. The COUNTER(6) takes each pulse and adds it to the previous count. When nine is reached, the next pulse resets the COUNTER(6) to one, and sends a carry out signal (PIN 11) to the second DECADE COUNTER(7).

Figure 2:
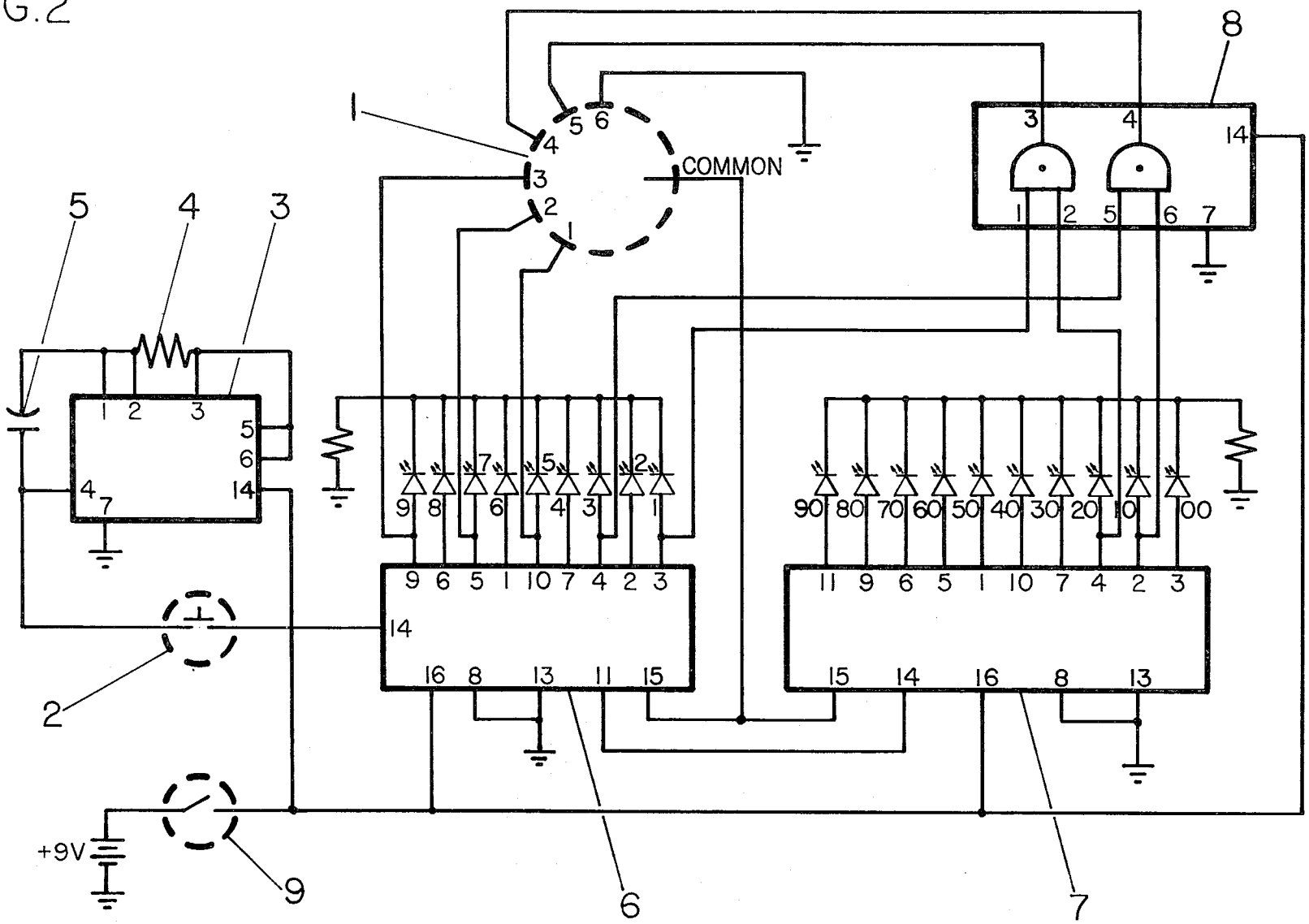

The count of the DECADE COUNTERS are outputted through the pins designated as such as detailed in FIG. 2. When the output is high, a 10 milliamp supply lights the respective LED. This lighted LED indicates the number rolled by reading the number off the case. When a double digit number is rolled, the number is read by adding the two numbers next to the lighted LED's.

When the ROTARY SWITCH(1) is in position one, a number from 1 to 4 is generated. The DECADE COUNTER(6) receives the input pulses and begins adding. When the count reaches five, pin 10 goes high. PIN 10 however is now connected through the ROTARY SWITCH(1) to PIN 15. The high output from PIN 10 therefore also reaches PIN 15, which resets the COUNTER(6) to one.

When the ROTARY SWITCH(1) is in position two, a number from 1-6 is generated. This time when the count reaches seven, pin 5 of the COUNTER(6) goes high. PIN 5 is connected through the ROTARY SWITCH(1) to PIN 15, which resets the COUNTER(6) to one.

When the ROTARY SWITCH(1) is in position three, a number from 1-8 is generated. When the count reaches nine, pin 9 goes high. PIN 9 is connected through the ROTARY SWITCH(1) to PIN 15, which resets the COUNTER(6) to one.

When the ROTARY SWITCH(1) is in the fourth position, a number from 1-2 is generated. This time the COUNTER(6) is allowed to count through one cycle, which allows the COUNTER(6) to deliver a carry out signal from PIN 11 to PIN 14 of the second COUNTER(7). The second COUNTER(7) then switches from 00 to 10. When the number thirteen is reached, pin 3 from the first COUNTER(6) and pin 2 of the second COUNTER(7) goes high. Both these signals are sent to the input of AND GATE(8) CMOS 4081. The output of the AND GATE(8) is connected through the ROTARY SWITCH(1) to pin 15 of both COUNTERS. The first COUNTER(6) resets to one while the second COUNTER(7) resets to 00.

When the ROTARY SWITCH(1) is in the fifth position, a number from 1-20 is generated. When the number 21 is reached, pin 3 of the first COUNTER(6) and pin 4 of the second COUNTER(7) goes high. These pins are sent through the inputs of the AND GATE(8). And AND GATE(8) output is connected through the ROTARY SWITCH(1), resetting the COUNTERS to one and 00.

When the ROTARY SWITCH(1) is in the sixth and final position, a number from 1-100 is generated. This time pin 15 from both COUNTERS are connected through the ROTARY SWITCH(1) to ground. This allows both COUNTERS to cycle and count unimpeded, resetting only when the number 99 is reached.

We claim:

1. An electronic die for simulating a multi-sided die or dice comprising a source of energy for supplying power to the circuitry of the simulated die; a clocking gate means for producing clock pulses; decade counter means; momentary switch means connecting said clocking gate means to said decade counter means for initiating random counting; a display means connected to said decade counter means for simulating a die or dice; and a multi-position switch means connected to said decade counter means, each switch position representing a distinct multi-sided die whereby activation of said momentary switch means permits clocking pulses to activate the decade counter means to randomly energize the display means in accordance to a preselected multi-sided die represented by the position selected on said multi-position switch means.

* * * * *